United States Patent [19]

Rogall

[11] Patent Number: 4,712,792

[45] Date of Patent: Dec. 15, 1987

[54] GYMNASTIC AND PLAYING DEVICE

[76] Inventor: Wolfgang Rogall, Kirchstrasse 1, 3012 Langenhagen 4, Fed. Rep. of Germany

[21] Appl. No.: 860,733

[22] Filed: May 7, 1985

[30] Foreign Application Priority Data

Jul. 24, 1985 [DE] Fed. Rep. of Germany ..... 3526368

[51] Int. Cl.[4] ..... A63B 15/00

[52] U.S. Cl. ..... 272/93; 272/124; 272/122

[58] Field of Search ..... 441/55–59; 272/93, 71, 122, 123, 116, 124, 67, 68; 84/477 B; 273/84 R, DIG. 7; 135/65

[56] References Cited

U.S. PATENT DOCUMENTS

D. 26,418 12/1896 Heydrick ..... 272/122
1,638,003 8/1927 Neumann ..... 272/67
1,726,554 9/1929 Gagnon ..... 273/84 R
3,113,482 12/1963 Hirsch ..... 84/477 B
3,542,363 11/1970 Bishop ..... 272/68
3,810,411 5/1974 Schambacher ..... 84/477 B
4,643,417 2/1987 Nieman ..... 272/67

*Primary Examiner*—Richard J. Apley
*Assistant Examiner*—S. R. Crow
*Attorney, Agent, or Firm*—Beveridge, DeGrandi & Weilacher

[57] ABSTRACT

A gymnastic and playing device is shown formed of a rod that is made of bending resistant material and having on each end of the rod a pear-shaped thickened section where the conical sections of each thickened section face each other. The outer portions of each pear-shaped section has a ball-like contour and is comprised of elastic deformable material. The pear-shaped sections have at least one circumferential groove configured to receive the fingers of a hand.

10 Claims, 1 Drawing Figure

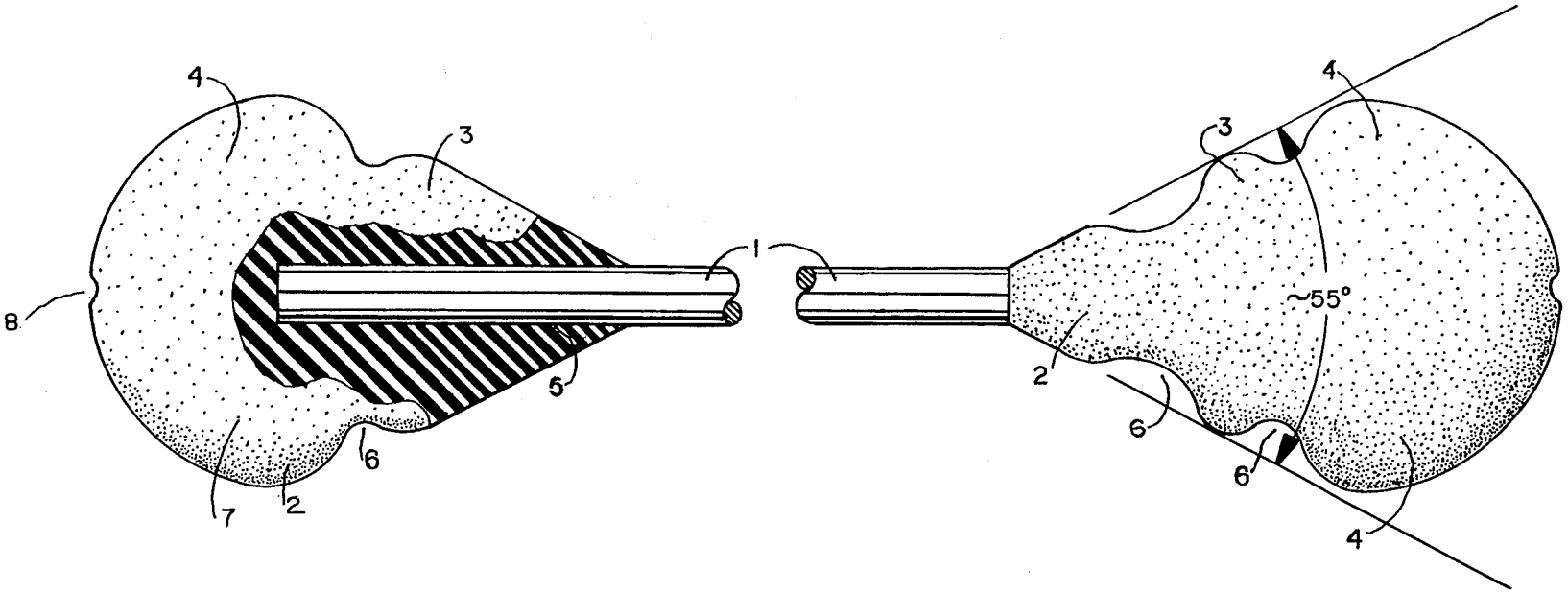
1
2
3
4
5
6
7
8
~55°

GYMNASTIC AND PLAYING DEVICE

The invention relates to a gymnastic and playing device formed of an essentially bending-resistant rod, having elastically deformable thickened bodies attached at the ends of the rod, whereby the axis of rotation of the thickened bodies and the longitudinal axis of the rod coincide.

BACKGROUND OF THE INVENTION

According to the known devices of this kind, the end thickenings are spherically shaped, that is a sphere is located at each end. It is true, that it is possible with these devices to carry out some exercises; however, the attachment of a spherical globe at each end of the rod presents difficulties; moreover, the transition from the stick to the spherical thickened sections has turned out to be unhandy and inexpedient.

SUMMARY OF THE INVENTION

The invention is based essentially on the task of improving the above devices in such a way that they will become handier and may be used for other possibilites of utilization. In addition, the invention strives to achieve a stronger connection between the rod and the thickened end bodies.

For the solution of this task and according to the invention, the thickened end portions of the rod are made essentially pear-shaped in such a way that their conical sections face each other.

In the device of the present invention, the point of connection between the rod and the thickened end portion are enlarged by an amount corresponding essentially to the length of the conical part of the thickened section; thus a durable, intimate connection will be achieved, which is particularly important because of the elastic deformations of the thickened sections. Furthermore, the pear shape configuration of the enlarged terminal sections leads to a harmonic, gradual transition between the rod and the largest diameter of the thickened end portion. This now additionally provided section of the thickened end portion enables the placing of indentations or grooves in the thickened end sections in order to be able to increase the handiness of the device. It furthermore is possible to keep the thickened section in the area of its largest diameter smooth and thus capable of being rolled off and to design a desired profile in the remaining conical area.

The conical area, determined by the pear shape is made preferably with an opening angle of about 45°–65° and an overall length of the thickened end section of say 70–100 mm and a maximum diameter of about 50–70 mm.

The terminal surfaces of the thickened sections may also be provided with notches, in order to balance the device more easily when standing upright, as for example, when stacking the devices together.

BRIEF DESCRIPTION OF THE DRAWING

The invention is further illustrated by the accompanying drawing which shows a gymnastic and playing device. The rod is shown broken and thereby indicates that the length of the rod is not drawn to scale.

In further detail, the FIGURE shows a gymnastic device in a top view, wherein, however, each of the thickened sections is different for purposes of illustrating the invention, and one thickened end is shown in partial sectional view.

DETAILED DESCRIPTION OF A PREFERRED EMBODIMENT

An essential component of the device of the invention is a bending-resistant rod (1) with a diameter of, for example, 8–10 mm. It is made preferably of a bending resistant plastic, and especially of glass fiber, in order thus to achieve a high mechanical strength and toughness. The rod is in a broken section in the FIGURE simply for illustrative purposes. Tough, resilient synthetic substanes are well known for use in fabricating the rod of this device. At the two ends of the rod (1), there are thickened sections (2) of approximate pear-shaped form, and having a generally conical section (3) and a hemispheric section (4) at the end, which terminates each end of the device. The area or section between the hemispherical end portion and the conical section is of a non-hemispherical shape containing at least one circumferential indentation. It is to be noted that the two thickened sections having their respective conical sections (3) in facing relationship with each other.

The thickened end sections (2) can be formed of a cellular rubbery material, or a rubbery material having pores, or a plastic similar to rubber in such a way that elastically deformable end parts will result. Natural or synthetic rubbers or rubbery polymeric material of the desired characteristics can be used for this purpose. These substances are known in the art. Thus even a soft foam may be used, or even a homogeneous, non-cellular or porous material can be utilized. Construction of the device in this way facilitates grabbing of the device by users. The thickened sections (2) have a central bore (5) as a pocket hole, which ends at the point of the largest diameter of the thickened section (2) and is fitted with the ends of rods. The thickened section (2) at the same time may be placed on the rod with prestress, may be made to adhere to or be connected in some other way with the end of the rod.

The opening angle of conical section (3) as shown is about 55°, and forms an essentially smooth transition without interruptions between the surface of the rod 1 and the conical section of the thickened section (2). This is the angle formed between two lines, each drawn tangent to the conical surface of the thickened sections from a point located on the rod ahead of the point where the thickened section meets the rod to a point out beyond the end of the thickened sections. This angle can range from about 45° to 65°.

In order to ensure a sufficient ability to be gripped by the user of the device in the area of the thickening (2), the section (3) is designed with one, possibly with two, circular and gradually deepening circumferential grooves (6). As a result of that, a knoblike formation is formed in the area of the largest diameter of the thickened section, which simplifies a clutching or grabbing of the thickened section (2) from the terminal end. This knob-like formation is indicated at (7) and is formed at the hemispherical end of the device.

At the outermost end of the device there is also a notch (8), which simplifies a balancing of the device in a perpendicular position; for this a second device or possibly an extended finger member (now shown) may be used.

It is furthermore important, that the conical section (3) may yet be profiled with even a larger angle, however, it is advisable to form the thickened section (2) in the area of its largest diameter, viewed in the peripheral direction, always smooth in such a way that the device be able to roll on a level support surface. That is, the hemispherical end is formed with a smooth peripheral surface at the point of maximum diameter.

It is advantageous according to the invention that the device over its entire length has a dimension of about 300–500 mm.

In accordance with the foregoing description, the device of the present invention can be used in manifold ways for rythmic exercises and play.

I claim:

1. An exercise stick comprising:

two pear-like members having the same size and shape, each of the members having a tapering portion terminating in a thickened outer portion at one end and a narrow portion having a central bore therein at the other end, the outer portion of each member being ball-like and comprising elastic, deformable material in the axial direction and having a largest radial section providing a smooth surface for adapting the exercise stick to roll on a flat surface, the tapering portion of each member having at least one circumferential groove configured to receive fingers of a hand; and a cylindrical, flexural rod having two opposing end portions received within the narrow portion of each pear-like member to connect the members in spaced-apart relationship, the rod having an axial length substantially several times longer than the axial length of the tapered portion.

2. An exercise stick as claimed in claim 1, wherein the central bore of each tapered portion has a depth corresponding to the axial distance between the end of the narrow portion and the largest radial section.

3. An exercise stick as claimed in claim 2, wherein each tapered portion and the rod form an angle of 45° to 65°.

4. An exercise stick as claimed in claim 3, wherein the outer portion has a notch.

5. An exercise stick as claimed in claim 4, wherein the tapered portion has an incline of about 55°.

6. An exercise stick as claimed in claim 5, wherein the pear-like members have a diameter of about 50–70 mm and an axial length of about 70–100 mm.

7. An exercise stick as claimed in claim 6, wherein the bore has an axial depth corresponding to the axial length of the tapered portion.

8. An exercise stick as claimed in claim 7, wherein the length of the stick is about 300–500 mm.

9. An exercise stick as claimed in claim 8, wherein the rod comprises a resilient plastic and has a diameter of about 8–10 mm.

10. An exercise stick as claimed in claim 9, wherein the rod is made of glass fiber.

* * * * *